United States Patent [19]

Nichols

[11] Patent Number: 4,894,171

[45] Date of Patent: Jan. 16, 1990

[54] METHOD FOR REMOVING SALTS FROM HERBICIDE SOLUTIONS

[75] Inventor: Keith H. Nichols, Houston, Tex.

[73] Assignee: Fermenta Plant Protection Company, Mentor, Ohio

[21] Appl. No.: 162,094

[22] Filed: Feb. 29, 1988

[51] Int. Cl.[4] ..... B04B 3/00

[52] U.S. Cl. ..... 210/772; 210/781; 210/909; 210/379

[58] Field of Search ..... 210/378, 379, 772, 774, 210/781, 909, 790, 196

[56] References Cited

U.S. PATENT DOCUMENTS

| | | | |
|---|---|---|---|
| 1,991,490 | 2/1935 | Brewer | 210/772 |
| 2,370,999 | 3/1945 | Schutte | 210/378 |
| 4,175,040 | 11/1979 | Sammons et al. | 210/379 |
| 4,634,536 | 1/1987 | Grimwood et al. | 210/781 |

FOREIGN PATENT DOCUMENTS

| | | |
|---|---|---|
| 335002 | 3/1921 | Fed. Rep. of Germany . |
| 384235 | 11/1923 | Fed. Rep. of Germany . |

*Primary Examiner*—Peter Hruskoci
*Assistant Examiner*—Christopher Upton
*Attorney, Agent, or Firm*—Fay, Sharpe, Beall Fagan, Minnich & McKee

[57] ABSTRACT

A centrifugal apparatus for removing salts from herbicide solutions is provided comprising an outer cylindrical casing for enclosing a vertically rotatable spin basket. The outer cylindrical casing consists of a top wall, vertical side walls and a bottom wall with open passages for throughflow of spent filter media from said spin basket. The top wall supports a means for applying filter media against the internal walls of the spin basket, a means for spraying feed slurry against the internal walls of the spin basket, a means for spraying solvent against the internal walls of the spin basket, and a vertically rotatable plowing means. The vertical side walls support an internal upper collection trough for collecting liquid overflow from the spin basket when the spin basket is rotated, and with the bottom wall of the casing forms an internal lower collection chamber for collecting filtrate which flows through the spin basket when the spin basket is rotated. The bottom wall of the centrifuge has means for supporting the spin basket within the casing.

Piping for transporting fluid collected from said upper overflow collection trough is also provided, as well as piping for transporting fluid collected from the lower collection chamber. A driving means for rotating the spin basket is also connected to the centrifugal. A method for removing salts from herbicide solutions utilizing the above apparatus is also provided.

7 Claims, 3 Drawing Sheets

METHOD FOR REMOVING SALTS FROM HERBICIDE SOLUTIONS

The present invention relates to an improved process for removing salt by-products from herbicide solutions. More particularly, the present invention is directed to a modified basket centrifuge and the use of the modified basket centrifuge to increase the production yield of desalinated DACTHAL (dimethyl ester 2,3,5,6-tetrachloroterephtalic acid) solutions.

BACKGROUND OF THE INVENTION

DACTHAL is a trademark of the Fermenta Plant Protection Company, Mentor, Ohio, for a composition of dimethyl ester 2,3,5,6-tetrachloroterephthalic acid, commonly known as DCPA, used in pre-emergence weed control. As a result of its favorable crop tolerance properties, DACTHAL's major areas of use are in vegetables and turf. DACTHAL is applied to the soil prior to the emergence of the crops (and/or weeds) above the soil line. The DACTHAL then kills or interferes with the life cycle of the weeds, to increase the yield and/or quality of the crops.

DACTHAL is produced by Fermenta, and others, through a series of photochlorination, fusion, thermal chlorination, esterification and distillation reactions. In the process for producing DACTHAL, sodium chloride, and organic salts, such as sodium salts of tetrachloroterephthalic acid, are produced as by-products. However, since the sodium chloride and tetrachloroterephthalic acid salt by-products generate many harmful effects on crops and foliage, it is desirous to remove the salt by-products from the DACTHAL solution.

The conventional method of desalinating the DACTHAL solutions concerns the use of a standard basket centrifuge to separate the waste salt solids from a solution of DACTHAL (product) and xylene (solvent). Centrifugal separation is a mechanical means of separating the components of a mixture by accelerating the material in a centrifugal field. Centrifugal separation of a mixture of immiscible components makes use of either density differences between the components or drainage of a liquid phase through a packed bed or cake of solid particles.

In the preferred conventional method for separating the waste salt solids from the DACTHAL solution, the salt solids are removed by centrifugation in a steam jacketed "Sharples" (The Sharples Corp.) centrifuge with a 48" diameter × 30" MONEL (trademark of Huntington Alloys, Inc., Alloys International, Inc. for a large group of corrosion-resistant alloys of predominantly nickel and copper) basket and a 40 HP, 1750 RPM Oilgear hydraulic drive unit. A plow and a plow stop mechanism for precoat usage is provided in the centrifuge. A precoat or filter aid media such as diatomaceous earth (J.M. Celite AFII Precoat and/or FilterMedia Precoat) is deposited approximately 2.5 to 3.0 inches in depth, on a fine mesh screen lining the centrifuge basket by standard procedure utilizing the dual inflow feed pipe of the Sharples centrifuge. Precoating improves the performance and efficiency of the centrifuge substantially and the quality of the precoat layer is an important variable in determining centrifuge performance.

A slurry consisting of the DACTHAL product, the xylene solvent and the waste solids (including the harmful salt by-products generated in the DACTHAL production process) is then fed (sprayed tangentially) through the dual inflow feed pipe into the spinning centrifuge basket (500–700 rpm) containing the precoat, where the solids are deposited on the surface of the filter media, while the liquid DACTHAL-xylene solution penetrates the media and exits via perforations in the basket and is collected in the outside chamber of the centrifuge. The feed rate and feed cycle times of the slurry vary depending upon the nature of the precoat which deteriorates with successive feed cycles, and the quality of the slurry.

The liquid is then drained from the centrifuge chamber and is routed to the centrifuge product tank. From the centrifuge product tank, the DACTHAL-xylene solution is pumped through a pressure leaf filter and a polishing filter to remove trace amounts of salt before going into a stripper feed tank. The solution is then pumped from the stripper feed tank to a xylene stripper to separate the xylene from the DACTHAL, resulting in a desalinated and purified end-product.

Following the feed cycle, the speed of the centrifuge basket is increased (650–1000 rpm) to remove as much of the residual xylene-DACTHAL solution from the wet cake as possible, before the solvent wash cycle. The length of this spin period varies depending upon the amount of time required to obtain a cake surface free of mother liquor from the slurry solution.

Upon completion of the spin cycle, hot xylene (at about 120° C.) is sprayed on to the cake while the basket is still spinning (650–1000 rpm) to displace and dissolve (thereby recovering) most of the DACTHAL in the salt cake. A second spin cycle (650–1000 rpm) then follows to remove any residual xylene from the previous two cycles. The second spin cycle continues until there is no free liquor in the bottom of the basket and the cake appears to be smooth and dry.

After the second spin cycle, the spin of the centrifuge basket is decreased from about 650–1000 rpm to about 40–60 rpm for the unload cycle. During this cycle the unloader (plow) slowly moves into the salt cake, removing the cake and a small portion of the precoat until the plow stop is reached. The cake and precoat removed by the plow fall from the centrifuge basket through a salt chute into a hot oil jacketed, double screw salt cake conveyor/vaporizer. The screw is heated to vaporize and remove xylene from the salt and precoat before the salt and precoat are dumped and disposed of. The xylene solvent is then recycled for use in the washing cycle.

Upon completion of the unload cycle, the machine automatically returns to the acceleration cycle and the feed cycle begins anew to produce an additional batch of desalinated DACTHAL.

The above cycles are repeated and new batches of desalinated DACTHAL are produced until new precoat needs to be added or replaced. The position of the plow stop is altered between every other batch to allow successively deeper penetration of the plow blade into the precoat. While plowing renews the surface of the filter media, it also eventually depletes the supply of media, necessitating fresh precoat application. New precoat is applied after approximately twelve hours of continuous operations, and once every 24 hours the entire precoat layer is replaced by standard methods.

Although the above conventional method of removing the harmful salt by-products of a DACTHAL slurry has been effective in producing desalinated DAC- THAL solutions, the following limitations have been noted:

A. Throughput

1. Centrifuge feed capacity is limited to the drain rate of solution through the filter media. This drain rate is determined by media condition, which deteriorates with successive feed cycles, and slurry quality variability.

2. Limited feed rates prolong the required duration of the feed portion of a centrifuge cycle. Normally transport rates through the filter cake decrease, with increased cake depth. Some efficiency loss therefore occurs as prolonged feed periods incur diminishing solution throughput. The diminishing return of extended feed periods thus limits total capacity.

3. Erratic feed capacities force limitation of feed rates to non-optimal performance according to "average" operating conditions or "worst case" operating conditions.

4. The conventional method dictates plow-out of the centrifuge before a basket is full. This reduces overall throughput.

B. Waste Disposal

1. The conventional method dictates a reduced slurry feed rate. The reduced velocity of liquid flow across the face of the centrifuge basket allows segmentation of solids according to mass and particle size. Coarse particles settle first, close to the feed nozzle. Finer particles flow upward and form a film that decreases in porosity with distance from the feed point. This non-porous band becomes impenetratable to rinse solvent and actually seals the surface of the filter media, disallowing proper draining of the filter media. Solids dropped from the basket are therefore wet with solvent and contain high concentrations of product. Significant costs are incurred to enable disposal of solids laden with particular solvents and product loss is an additional cost factor.

C. Product Quality

1. The conventional method exposed the operation to periodic overflow of the centrifuge basket. During the normal course of operation of the conventional method, salt gradually permeates the filter media, partially plugging it off and reducing the drain rate of the slurry, (see above). This, in turn, increases the tendency of the basket to overflow during the feed cycle, thereby increasing the amount of insoluble solids in the filtrate. Solids passing over the top of the basket required removal in subsequent filtration systems. This decreases efficiency, adds equipment and personnel costs and increases personnel chemical exposure. (This is due to operation of subsequent filtration systems).

It has now been found that the limitations of the above described conventional method and apparatus for desalinating DACTHAL can be overcome by the present invention.

SUMMARY OF THE INVENTION

It is therefore the object of the present invention to provide an improved centrifuge, and a method of utilizing the improved centrifuge, to remove salt by-products from DACTHAL (2,3,5,6-tetrachloroterephthalic acid) solutions.

More particularly, the present invention relates to a centrifugal apparatus for removing salts from herbicide solutions comprising an outer cylindrical casing for enclosing a vertically rotatable spin basket. The outer cylindrical casing consists of a top wall, vertical side walls and a bottom wall with open passages for flow-through of spent filter media from said spin basket. The top wall supports a means for applying filter media against the internal walls of the spin basket, a means for spraying feed slurry against the internal walls of the spin basket, a means for spraying solvent against the internal walls of the spin basket, and a vertically rotatable plowing means. The vertical side walls support an internal upper collection trough for collecting liquid overflow from the spin basket when the spin basket is rotated, and with the bottom wall of the casing forms an internal lower collection chamber for collecting filtrate which flows through the spin basket when the spin basket is rotated. The bottom wall of the centrifuge has means for supporting the spin basket within the casing. Inside the centrifuge is a spin basket of smaller diameter and shorter height than the casing. The spin basket is centered on a vertical axis and is rotatable relative to the supporting means about the axis. The basket has means for supporting a filter bed including a radially outer layer of fine mesh screening and a radially inner layer of precoat filter media. The basket has a closed top ledge portion to support the filter bed and an open top portion to permit solution overflow when flow-through the precoat filter bed is restricted. Piping for transporting fluid collected from said upper overflow collection trough is also provided, as well as piping for transporting fluid collected from the lower collection chamber. A driving means for rotating the spin basket is also connected to the centrifugal. A method for removing salts from herbicide solutions utilizing the above apparatus is also provided.

BRIEF DESCRIPTION OF THE INVENTION

The invention may take physical form in certain parts and arrangements of parts, a preferred embodiment of which will be described in detail in the specification and illustrated in the accompanying drawings which form a part hereof, and wherein.

DETAILED DESCRIPTION OF THE INVENTION

Figure 1:
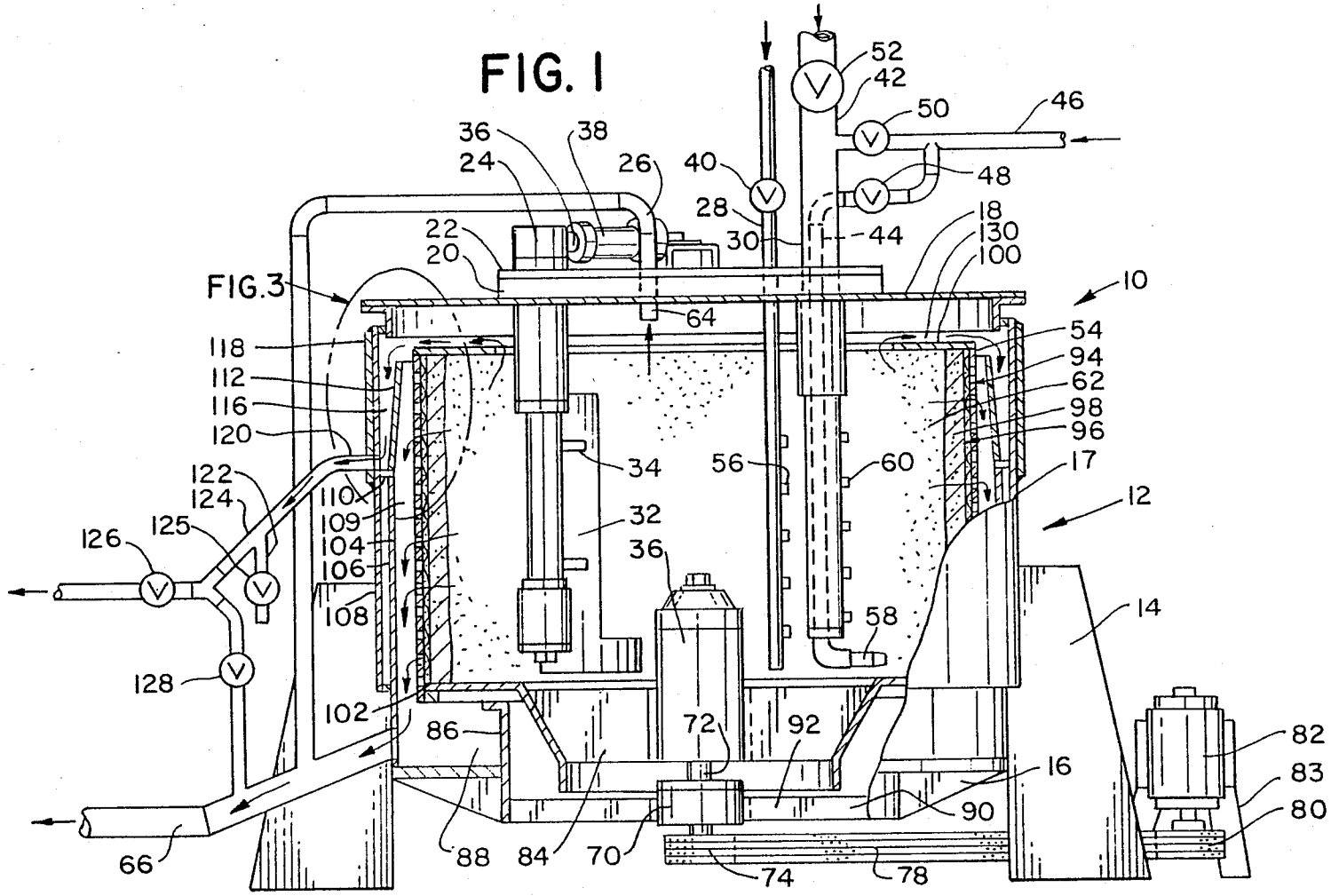
FIG. 1 is a broken open vertical view of the apparatus of the present invention, taken generally centrally showing the relationship of its constituent parts to one another, with certain parts shown schematically.
Figure 2:
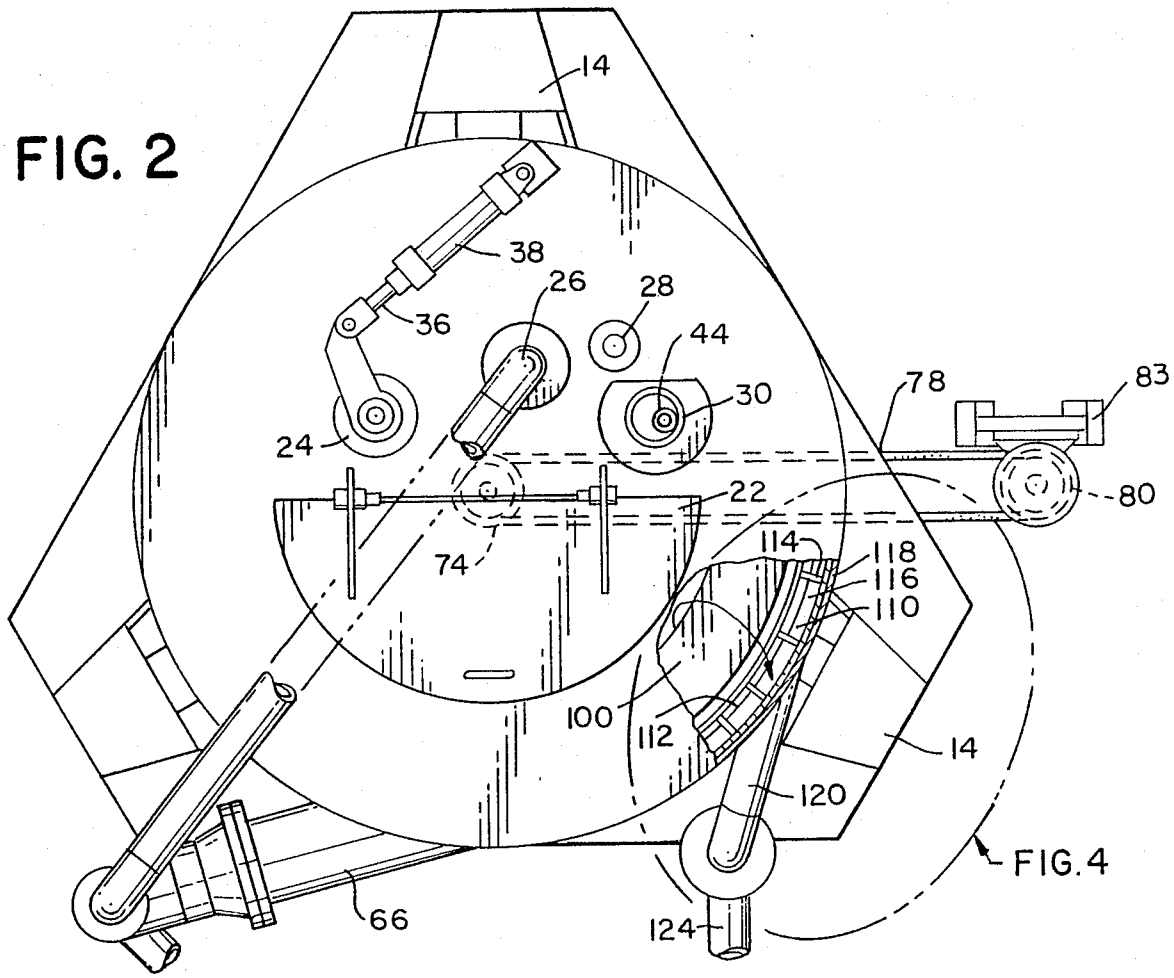
FIG. 2 is a top elevational view of the apparatus shown in FIG. 1 with a part broken away to show the relationship of the collection trough and the spin basket.

The present invention is directed to an improved process for removing salt by-products from DACTHAL (dimethyl ester 2,3,5,6-tetrachloroterephthalic acid) solutions. The inventor has discovered that by redesigning the conventional Sharples 48" basket centrifuge through the fabrication and installation of an additional collection trough in the upper portion of the inside wall of the outer chamber of the centrifuge, and by connecting collection piping to this trough, to allow diversion of the collected material to either the centrifuge product tank or recycling the collected solution to the centrifuge feed tank, that the production yield of the desalinated DACTHAL solution is greatly increased.

More particularly, the inventor modified the Sharples 48" Tornado Centrifuge by first welding a support ring (approximately 12 inches wide and ½ inch thick (having an outer diameter of 57 ½ inches and an inner diameter of 6 ½ inches) around the upper 13 inches of the outside wall of the outer chamber of the centrifuge. The top 10 inches of the steam jacket lining the inside wall of the outer chamber of the centrifuge was then removed. To seal the steam jacket, the outside edge of a 1 inch ring (¼ inch thick, having an outer diameter of approximately 55 ½ inches and an inner diameter of approximately 53 ½ inches) was welded to the inside wall of the outer chamber of the centrifuge, while the inside edge of the 1 inch ring was welded to the inside wall of the steam jacket. The 1 inch ring welded to the inside wall of the outer chamber of the centrifuge and to the inside wall of the steam jacket, prevented steam from escaping from the steam jacket, as well as served as a base plate for the collection trough.

The lower edge of a 10 inch ring (¼ inch thick, having an outer diameter of approximately 50 ¾ inches and an inner diameter of approximately 51 ½ inches at its upper edge, and an outer diameter of approximately 54 ¼ inches and an inner diameter of approximately 53 ½ inches at its lower edge) was then welded to the inner end of the 1 inch ring base plate to serve as the inner wall of the collection trough. In turn, the upper edge of the 10 inch ring was welded to the inner end of 25 1 ½ inches, ½ inch in diameter, brace rods, which were welded (unevenly spaced around the circumference of the upper end of the outer chamber by the centrifuge) by their outer ends to the inner wall of the outer chamber. The 10 inch ring welded at its lower end to the 1 inch base plate and at its upper end to the 25 brace rods, serves as the collection trough and is affixed around the inside circumference of the inner wall of the outer chamber.

In order to connect the collection trough to the centrifuge product tank or the centrifuge feed tank, a 3 inch outlet hole was drilled (at the base of the collection trough) through the support plate and the outer chamber of the centrifuge. A 3 inch pipe containing a tee and two valves was then inserted and welded to the outer chamber and the support plate of the centrifuge in a tangential configuration. Connective piping was then attached to the two tee ends of the outflow pipe, connecting one end to the centrifuge product tank via the lower collection pipe, and the second end to the centrifuge feed tank.

The above modifications greatly increased the capacity of the centrifuge while also significantly improving the quality of the desalinated product (i.e. DACTHAL) and waste cake. Specifically, the following improvements and advantages are noted:

A. Throughput

1. Filter media drain rates were no longer the determining factor for feed rates. Feed rates were increased to allow overflow of product from the spinning basket (see Table 1 below). Material overflowing early, i.e. during the first half of the feed cycle, was found to be comparable to the filtered product (material which had actually passed through the filter media and basket) with respect to solids contamination. This solution could be passed to the centrifuge product tank.

2. Material overflowing during the second half of the centrifuge feed cycle was found to have solids concentrations substantially better than the feed stream. This partial solids removal capability is taken advantage of by returning this overflow material back to the centrifuge feed tank. The overflow route of the basket thus becomes a slip-stream solids removal system. (Subsequent feeds to the centrifuge, therefore, contain progressively lower solids concentrations, elevating possible basket capacity).

3. The duration of the feed phase of the centrifuge cycle was extended (see Table 1). This allowed the basket to become "full" during each cycle. Overall throughput was thereby greatly increased.

4. Control parameters, such as feed times and feed rates, could be set at levels that assume "ideal" operation rather than "worst case" operation, i.e. basket overflow was no longer a limiting consideration for these parameters. The impact of product variability and filter media deterioration is therefore minimized.

B. Waste Disposal

1. Expanded feed rates increased some of the vertical velocity of the slurry up across the surface of the filter media. This has improved particle size distribution across the face of the media. Fine particles are therefore dispersed among the coarser particles allowing uniform drain rates across the cake. This reduces formation of wet bands previously caused by a concentrated film of fine particles. Waste material therefore drains better, allowing better rinsing and product removal. The waste solids are also consistently drier and ready for landfill disposal. (See Table 1)

C. Product Quality

Improved product quality control has allowed elimination of some of the filtration equipment downstream of the centrifuge. As a result of the improved quality of the desalinated DACTHAL product produced by the present invention, use of the Leaf Filter and the Polishing Filter to remove trace salts from the DACTHAL solution, has been eliminated.

TABLE 1

| | Conventional | Present Invention |
|---|---|---|
| Acceleration 1 (minutes) | 1 | .75 |
| Feed (minutes) | 10–12 | 12–18 |
| Feed Rate (GPM) | 15–30 | 30–42 |
| Acceleration 2 (minutes) | .5 | .5 |
| Spin 1 (minutes) | 6–10 | 3–6 |
| Wash (minutes) | .75 | .75 |
| Spin 2 (minutes) | 6–10 | 3–6 |
| Deceleration (minutes) | .75 | .75 |
| Unload (minutes) | 5 | 5 |
| Total Cycle Time (minutes) | 30–40 | 25–37 |
| Single Cycle Throughput | 150–360 | 360–756 |
| Net Hourly Throughput (gallons) | 300–540 | 864–1226 |
| Salt Cake Quality | | |
| % Product | 2%–6% wt. | .7%–2% wt. |
| % Xylene | 2%–10% wt. | .1%–2% wt. |
| Prevailing Centrate Solid Content | .5–2 ml/liter | Less than .1–.2 ml/liter |
| Total Amount of Desalinated DACTHAL Produced/Month | 500,000 lbs. | 600,000 lbs. |

The above brief description, as well as further objects, features, and advantages of the present invention will be more fully understood by reference to the following drawings wherein the showings are for purposes of illustrating the preferred embodiment of the invention only and not for purposes of limiting same.

Referring to FIGS. 1–4, the principles of the invention are shown as applied to a basket centrifuge 10 which is comprised of an outer cylindrical casing 12 mounted on three standards 14 at 120° intervals. Standards 14 can be of any physical configuration sufficient to support the weight of centrifuge 10. The casing 12 includes a bottom wall 16, vertical side walls 17, and a top wall 18.

Top wall 18 has a top opening 20 closed by an access door 22. In addition, top wall 18 of centrifuge casing 12 serves to support a rotatable plow shaft 24, a lower outflow vent pipe 26, a solvent feed pipe 28, and a dual precoat-slurry feed pipe 30. Rotatable plow shaft 24 is connected to plow 32 by a plow support members 34. Plow shaft 24 is mounted to a pneumatic plow motor 38 by plow motor linkage 36.

Solvent feed pipe 28 is connected to a solvent feed source (not pictured) by solvent feed valve 40. Solvent feed pipe 28 extends through top wall 18 into a spin basket 54. Solvent feed pipe 28 has a plurality of orifices 56 which are directed in a manner sufficient to spread the solvent tangentially or angularly in the direction of the spin basket rotation over the inner surface 62 of spin basket 54.

Dual precoat-slurry feed pipe 30 has an outer precoat-slurry feed pipe 42 and an inner slurry feed pipe 44. Inner slurry feed pipe 44 is connected to a major slurry feed pipe 46 by a slurry feed valve 48. Outer precoat-slurry feed pipe 42 is connected to major slurry feed pipe 46 by a valve 50 and to a precoat feed source (not pictured) by a valve 52. Major slurry feed pipe 46 is connected to a slurry feed source (not pictured).

Dual precoat-slurry feed pipe 30, containing an inner slurry feed pipe 44 and an outer precoat-slurry feed pipe 42, extends through top wall 18 into spin basket 54. Inner slurry feed pipe 44 has one orifice 58 which is directed in a manner to spray the slurry tangentially or angularly in the direction of the spin basket rotation over the lower region of the inner surface 62 of spin basket 54. Outer precoat-slurry feed pipe 42 has a plurality of orifices 60 which are directed in a manner to spread the precoat or the slurry tangentially or angularly in the direction of the spin basket rotation over most of the inner surface 62 of spin basket 54.

Lower outflow vent pipe 26 extends through top wall 18 to a port 64. Lower outflow vent pipe 26 is directly connected to a lower outflow pipe 66.

Bottom wall 16 is connected to a bearing support 70 by means of cross piece 90. Within cross piece 90 are passages 92 through which filter cake gravitates as will be explained later. Bearing support 70 journals a vertical spindle 72 having a pulley 74 fixed to its lower end, and a basket hub 76 attached to its upper end. Pulley 74 is connected by belt means 78 to a pulley 80 on the output shaft of a motor 82, which may be supported by supports 83 or any other suitable support means. Basket hub 76 is connected to a spin basket 54, which is of smaller diameter and shorter height of casing 11, by means of spokes 84, and thus spin basket 54 is rotated whenever the motor 82 is energized.

Spin basket 54 comprises an outer perforated wall 94 and an inner perforated liner 96, such as fine mesh screening, which extends between a ledge 100 and a bottom wall 102 of spin basket 54. The inner perforated liner 96 provides mechanical support for filter media or precoat 98. As the basket is rotated, precoat-slurry and/or solvent may be sprayed on the inner surface 62 of spin basket 54 by outer precoat-slurry feed pipe 42, inner slurry feed pipe 44, and/or solvent feed pipe 28, respectively.

Spin basket 54 is situational in casing 12 in such a manner as to produce a clearance, such as clearance 130, between top wall 18 and ledge 100 of spin basket 54. Clearance 130 acts as a by-pass around inner surface 62 of spin basket 54 when the solvent or the slurry flow to spin basket 54 is faster than the penetration rate of the solvent or the slurry into precoat 98.

Bottom wall 16 supports a tubular skirt 86 which is concentric with casing 12. Tubular skirt 86 extends above bottom wall 16, forming with vertical wall 17, a chamber 88 within which filtrate is collected. Lower outflow pipe 66 is affixed to chamber 88 in order to facilitate passage of filtrate to a centrifuge product tank (not pictured).

Vertical wall 17 consists of a inner wall 104, a steam jacket 106, and an outer wall 108. A support wall 118 is connected around the upper one half of outer wall 108 to add support. A base plate 110 is mounted around the inner surface of outer wall 108 and the outer surface of inner wall 104 thereby sealing steam jacket 106. A trough wall 112 is connected at its lower end to the inner edge of base plate 110 and at its upper end to outer wall 108 by means of brace bars 114, to form with outer wall 108 and base plate 110, an annular collection trough 116 (see FIGS. 3 and 4). Collection trough 116 collects the filtrate overflow from spin basket 54. An upper outflow pipe 120 is mounted in a corresponding opening in support wall 118 and outer wall 108 in communication with the interior of collection trough 116.

Upper outflow pipe 120 is connected to a test pipe 122 and to a tee pipe 124. Test pipe 122, containing valve 125 is utilized for testing the particulate solids concentration of the filtrate overflow. Tee pipe 124 is connected at one end via valve 126 to a centrifuge feed tank (not pictured), and the other end via valve 128 to lower outflow pipe 66.

The manner of operation of the apparatus and method of the present invention is as follows:

Motor 82 is turned on causing spin basket 54 to accelerate to 350–550 rpm. Valve 52 of outer precoat-slurry feed pipe 42 is opened causing precoat, a diatomaceous earth mixture of Filter-Media Precoat, J.M. Celite AF11 Precoat and xylene, to spray out of orifices 60 of dual precoat-slurry feed pipe 30 in a manner to spread the precoat tangentially or angularly in the direction of the spin basket rotation over the inner surface of spin basket 54. The precoat is applied until a precoat layer of 2.5 to 3.0 inches is built up in spin basket 54. When the desired precoat layer is achieved, valve 52 is closed, and the remaining precoat flows out of dual precoat-slurry feed pipe 30.

Upon completion of the precoat cycle, the speed of spin basket 54 is increased to 500–700 rpm and either valve 50 or valve 48 of major slurry feed pipe 46 is opened causing a slurry consisting of the DACTHAL product, the xylene solvent and the waste salt solids (heated to about 100° C.) to be sprayed tangentially or angularly against the surface of precoat 98 of spin basket 54 through either orifices 60 of dual precoat-slurry feed pipe 30 or orifice 58 of inner feed pipe 44. The slurry solution then either penetrates the precoat 98, or progresses vertically up the precoat surface due to the centrifugal force generated by the spinning basket. The variables which determine whether the slurry solution penetrates the precoat 98 or progresses vertically up the precoat surface include the quality and quantity of the precoat, the salt concentration of the slurry, the feed rate, the spin rate, etc.

In the situation where the slurry solution penetrates the precoat 98, the salt solids are deposited on the surface of the precoat 98, while the liquid DACTHAL-xylene solution filters through the precoat 98 and exits the perforated spin basket 54. The solution then drains down channel 109 and is collected in chamber 88, where the solution flows through lower outflow pipe 66 to a centrifuge product tank (not shown) for future processing.

Figure 3:
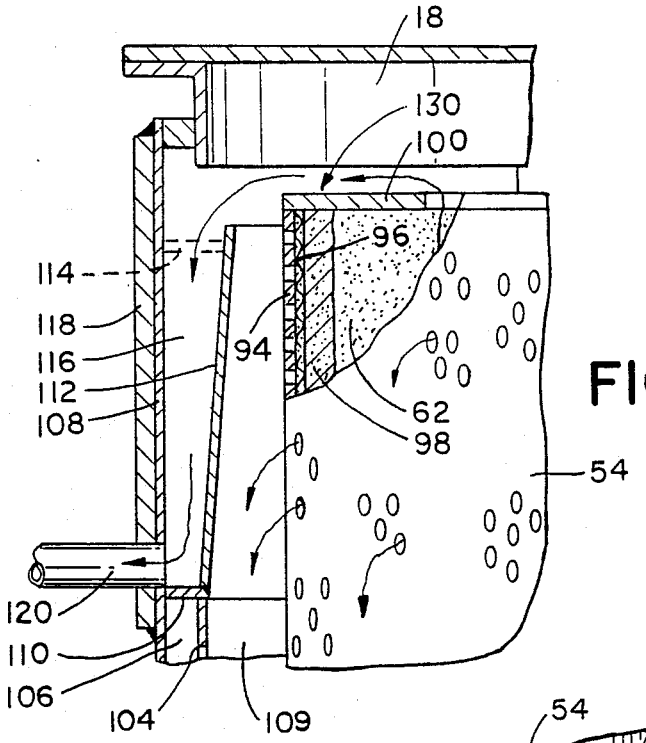
FIG. 3 is an enlarged vertical sectional view of the collection trough and spin basket of the apparatus as shown in FIG. 1; and, FIG. 4 is an enlarged horizontal view of the collection trough and the spin basket of the apparatus as shown in FIG. 2.
Figure 4:
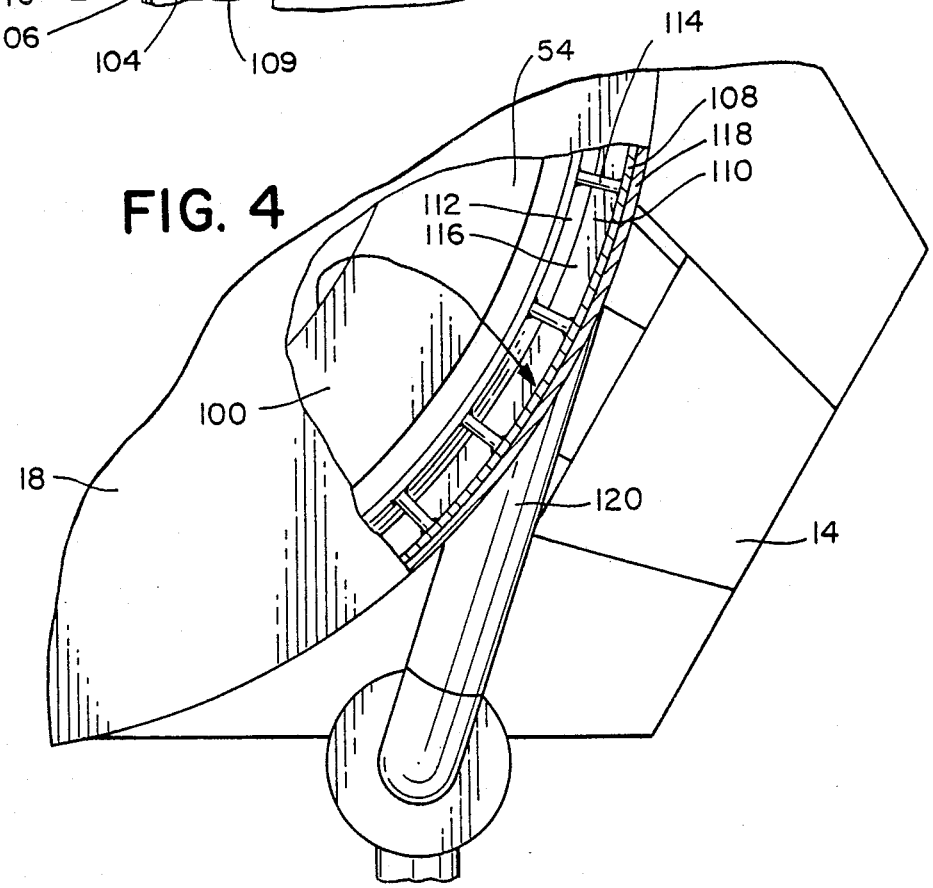

In the situation where the slurry-solution progresses vertically up the precoat 98 surface, the slurry-solution is forced over outer ledge 100 of spin basket 54 and is caught by collection trough 116 (see FIGS. 3 and 4). The solution then flows from collection trough 116 to tee pipe 124 where the solution is either diverted to a centrifuge product tank (not shown) for finish processing (i.e. stripping) via valve 128 and lower outflow pipe 66, or to a centrifuge feed tank (not shown) for recycling via valve 126, depending upon the salt quantity of the solution measured from test pipe 122 via valve 124.

Upon completion of the feed cycle, the speed of spin basket 54 is increased to 650–1000 rpm to remove as much of the residual xylene-DACTHAL solution from the wet precoat 98 (and salt cake formed thereon) as possible before the solvent wash cycle. The solution exits perforated spin basket 54, into channel 109, and is collected in chamber 88, where the solution is directed to a centrifuge product tank (not shown) through lower outflow pipe 66.

Following the spin cycle, hot xylene (at 120° C.) enters solvent feed pipe 28 through valve 40 and is sprayed tangentially or angularly on to the salt cake via orifices 56. The xylene is sprayed on to the cake while the spin basket 54 is still spinning (650–1000 rpm) to displace and dissolve (thereby recover) most of the DACTHAL in the salt cake. The DACTHAL-xylene solution either penetrates precoat 98, or progresses vertically up the precoat surface due to the centrifugal force generated by the spinning basket. The DACTHAL-xylene solution is then collected in either chamber 88 or collection trough 116. The DACTHAL-xylene solution collected in chamber 88 is transferred to a centrifuge product tank (not shown) by lower overflow pipe 66. The DACTHAL-xylene solution collected by a collection trough 116 is transferred to either a centrifuge product bank (not shown) or a centrifuge feed tank (not shown) by tee pipe 124 as indicated above. A second spin cycle (650–1000 rpm) then follows to remove and collect any residual xylene and DACTHAL solution.

After the second spin cycle, the speed of spin basket 54 is decreased from about 650–1000 rpm to about 40–60 rpm for the unload cycle. In the unload cycle, plow 32 is moved by plow motor 38, plow linkage 36 and rotatable plow shaft 24 to remove the salt cake formed on precoat 98 (as well as a small portion of the actual precoat) from the spin basket 54. The cake and the precoat removed by the plow from spin basket 54, then falls through passages 92 into a hot oil jacket, double screw salt cake conveyor/vaporizer (not pictured) where the xylene solvent is recovered.

Upon completion of the unload cycle, the speed of spin basket 54 is increased to begin a new feed cycle to produce additional batches of desalinated DACTHAL.

The invention has been described with reference to the preferred embodiment. Obviously modifications and alterations will occur to others upon a reading and understanding of the specification. It is intended to include all such modifications and alterations insofar as they come within the scope of the appended claims or the equivalents thereof.

Having thus described the invention, it is now claimed:

1. A method for removing salts from a herbicide solution comprising the steps of:

applying a filter media onto the internal walls of a rotating spin basket of a centrifugal apparatus having:

an outer cylindrical casing for enclosing a vertically rotatable spin basket, having a top wall, vertical side walls and a bottom wall;

wherein said top wall supports: a means for applying filter media onto the internal walls of said spin basket;

a means for spraying a herbicide solution containing salt solids from a feed tank onto the filter media present on the internal walls of said spin basket thereby separating the salt solids from the solution which penetrates through the filter media;

a means for spraying solvent onto the salt solids and filter media present on the internal walls of said spin basket thereby washing excess solution from the salt solids and the filter media; and a vertically rotatable plowing means for plowing the salt solids and spent filter media from the spin basket;

wherein said vertical side walls support:

an internal upper collection trough for collecting liquid overflow from said spin basket when said spin basket is rotated; and with said bottom wall, an internal lower radial collection chamber for collecting filtrate which flows through said spin basket when said spin basket is rotated; and wherein said bottom wall has openings for passage of spent filter media and means for supporting the spin basket within said casing;

wherein said spin basket is of smaller diameter and shorter height than said casing and is centered on a vertical axis and rotatable relative to said supporting means about said axis by means of a central hub having a plurality of spokes secured at their inner ends to the hub and at their outer ends to said spin basket;

wherein said basket has means for supporting a filter bed including a radially outer layer of fine mesh screening and a radially inner layer of precoat filter media;

and wherein said basket has a closed top ledge portion to support said filter bed, an open top portion to permit solution overflow when flow through said precoat filter bed is restricted and an open bottom to permit passage of spent filter media;

an overflow discharge outlet in communication with said upper overflow collection trough, wherein said overflow discharge outlet is connected to piping for transporting fluid collected from said upper overflow collection trough;

a filtrate discharge outlet in communication with said lower collection chamber, wherein said filtrate discharge outlet is connected to piping for transporting fluid collected from said lower collection chamber; and a driving means for rotating said spin basket;

spraying a herbicide solution containing salt solids onto the filter media present on the internal walls of said rotating spin basket where the centrifugal force produced by the rotating spin basket forces (i) a first portion of the salt solution to penetrate through the filter media and the spin basket into the internal layer radial collection trough of the apparatus, thereby depositing the salt solids present in the herbicide solution onto the filter media, and (ii) a second portion of the salt solution to progress vertically up the filter media surface, over the top ledge of the rotating spin basket, and into the internal upper radial collection trough of the apparatus;

spraying a solvent solution onto the salt solids and the filter media present on the internal walls of said rotating spin basket where the centrifugal force produced by the rotating spin basket forces (i) a first portion of the solvent solution to penetrate through the salt solids, the filter media, and the spin basket into the internal lower radial collection trough, thereby washing the excess herbicide solution from the salt solids and the filter media, and (ii) a second portion of the solvent solution to progress vertically up the filter media surface containing the salt solids, over the top ledge of the rotating spin basket into the internal upper radial collection trough of the apparatus, thereby washing the herbicide solution from the salt solids, the filter media surface, and the internal radial collection trough;

recycling a portion of said solvent solution from the upper radial collection trough to said feed tank increasing the rotation speed of said spin basket thereby increasing the centrifugal force produced by the rotating spin basket and forcing excess solvent and herbicide solution out of said filter media into said internal lower radial collection trough; and, decreasing the rotation speed of said spin basket and plowing the salt solids and spent filter media from the spin basket whereby the plowed solids fall through openings in the bottom of said spin basket and casing.

2. The method of claim 1, wherein said herbicide solution is dimethyl ester 2,3,5,6-tetrachloroterephthalic acid.

3. The method of claim 1, wherein said solvent is xylene.

4. The method of claim 3, wherein said xylene is heated to 120° C.

5. A method for removing salts from a tetrachloroterephthalic acid solution comprising the steps of:

applying a filter media onto the internal walls of a rotating spin basket of a centrifugal apparatus having:

an outer cylindrical casing for enclosing a vertically rotatable spin basket, having a top wall, vertical side walls and a bottom wall; wherein said top wall supports a means for applying filter media onto the internal walls of said spin basket;

a means for spraying a herbicide solution containing salt solids from a feed tank onto the filter media present on the internal walls of said spin basket thereby separating the salt solids from the solution which penetrates through the filter media;

a means for spraying solvent onto the salt solids and filter media present on the internal walls of said spin basket thereby washing excess solution from the salt solids and filter media; and a vertically rotatable plowing means for plowing the salt solids and spent filter media from the spin basket; wherein said vertical side walls support an internal upper collection trough for collecting liquid overflow from said spin basket when said spin basket is rotated; and, with said bottom wall, an internal lower radial collection chamber for collecting filtrate which flows through said spin basket when said spin basket is rotated; and, wherein said bottom wall has openings for passage spent filter media and means for supporting the spin basket within said casing;

wherein said spin basket is of smaller diameter and shorter height than said casing and is centered on a vertical axis and rotatable relative to said supporting means about said axis by means of a central hub having a plurality of spokes secured at their inner ends to the hub and at their outer ends to said spin basket;

wherein said basket has means for supporting a filter bed including a radially outer layer of fine mesh screening and a radially inner layer of precoat filter media;

and wherein said basket has a closed top ledge portion to support said filter bed, an open top portion to permit solution overflow when flow through said precoat filter bed is restricted and an open bottom to permit passage of spent filter media;

an overflow discharge outlet in communication with said upper overflow collection trough, wherein said overflow discharge outlet is connected to piping for transporting fluid collected from said upper overflow collection trough;

a filtrate discharge outlet in communication with said lower collection chamber, wherein said filtrate discharge outlet is connected to piping for transporting fluid collected from said lower collection chamber; and, a driving means for rotating said spin basket;

spraying a tetrachloroterephthalic acid solution containing salt solids onto the filter media present on the internal walls of said rotating spin basket where the centrifugal force produced by the rotating spin basket forces (i) a first portion of the salt solution to penetrate through the filter media and the spin basket into the internal lower radial collection trough of the apparatus, thereby depositing the salt solids present in the tetrachloroterephthalic acid solution onto the filter media, and (ii) a second portion of the salt solution to progress vertically up the filter media surface, over the top ledge of the rotating spin basket, and into the internal upper radial collection trough of the apparatus;

spraying a solvent solution onto the salt solids and the filter media present on the internal walls of said rotating spin basket where the centrifugal force produced by the rotating spin basket forces (i) a first portion of the solvent solution to penetrate through the salt solids, the filter media, and the spin basket into the internal lower radial collection trough, thereby washing the excess tetrachloroterephthalic acid solution from the salt solids and the filter media and (ii) a second portion of the solvent solution to progress vertically up the filter media surface containing the salt solids, over the top ledge of the rotating spin basket and into the internal upper radial collection trough of the apparatus, thereby washing the tetrachloroterephthalic acid solution from the salt solids, the filter media surface, and the internal radial collection trough;

recycling a portion of said solvent solution from the upper radial collection trough to said feed tank increasing the rotation speed of said spin basket thereby increasing the centrifugal force produced by the rotating spin basket and forcing excess solvent and tetrachloroterephthalic acid solution out of said filter media into said internal lower radial collection trough; and, decreasing the rotation speed of said spin basket and plowing the salt solids and spent filter media from the spin basket whereby the plowed solids fall through openings in the bottom of said spin basket and casing.

6. The method of claim 5, wherein said solvent is xylene.

7. The method of claim 6, wherein said xylene is heated to 120° C.

* * * * *